US006799414B2

(12) United States Patent
Pyra et al.

(10) Patent No.: US 6,799,414 B2
(45) Date of Patent: Oct. 5, 2004

(54) YARN TEXTURING MACHINE

(75) Inventors: Michael Pyra, Brüggen (DE); Thomas Wortmann, Remscheid (DE); Klemens Jaschke, Hückswagen (DE); Hans-Georg Schröder, Köln (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/722,707

(22) Filed: Nov. 25, 2003

(65) Prior Publication Data

US 2004/0103633 A1 Jun. 3, 2004

Related U.S. Application Data

(63) Continuation of application No. PCT/EP02/06504, filed on Jun. 13, 2002.

(30) Foreign Application Priority Data

Jun. 30, 2001 (DE) ..... 101 31 815

(51) Int. Cl.[7] ..... D01H 13/04

(52) U.S. Cl. ..... 57/280; 57/352

(58) Field of Search ..... 57/22, 280, 352; 28/272; 226/90

(56) References Cited

U.S. PATENT DOCUMENTS

| | | | | |
|---|---|---|---|---|
| 3,577,721 A | * | 5/1971 | Schmick et al. | 57/280 |
| 3,946,546 A | | 3/1976 | Venot | |
| 3,991,545 A | | 11/1976 | Ritter et al. | |
| 3,999,360 A | * | 12/1976 | Forin et al. | 57/280 |
| 4,412,371 A | * | 11/1983 | Hagen et al. | 28/255 |
| 5,675,879 A | * | 10/1997 | Nagao et al. | 28/272 |

FOREIGN PATENT DOCUMENTS

| | | |
|---|---|---|
| FR | 2 226 489 | 11/1974 |
| FR | 2 388 747 | 11/1978 |
| FR | 2 695 631 | 3/1994 |

* cited by examiner

*Primary Examiner*—John J. Calvert
*Assistant Examiner*—Shaun R Hurley
(74) *Attorney, Agent, or Firm*—Alston & Bird LLP

(57) ABSTRACT

A texturing machine for producing a crimped yarn and which has a plurality of serially arranged yarn processing units leading to a takeup device. A threading device is provided for threading a yarn for the first time before the start of a process. For this purpose, the threading device comprises at least one guide tube and an air injector connected thereto, with the guide tube including a suction inlet for receiving the yarn. In accordance with the invention, a cutting device is arranged in the region of the suction inlet of the guide tube, with the cutting device cutting the yarn while being threaded into the suction inlet.

16 Claims, 3 Drawing Sheets

YARN TEXTURING MACHINE

CROSS-REFERENCE TO RELATED APPLICATION

This application is a continuation of International Patent Application PCT/EP02/06504 filed Jun. 13, 2002, and which designates the United States. The disclosure of the referenced application is expressly incorporated herein by reference.

BACKGROUND OF THE INVENTION

The invention relates to a texturing machine for producing a crimped yarn.

To improve a melt spun yarn, it is known to crimp and draw the flat yarn in a texturing process. To this end, texturing machines are used, which comprise a plurality of processing units as well as a takeup device. The processing units, such as, for example, feed systems, heaters, cooling devices, texturing units, entanglement devices, and yarn lubricators are combined in a machine frame to result in a yarn path, which often extends over two stories of a machine.

In the case of such texturing machines, special auxiliary devices are integrated in the texturing machine, so as to make it possible to thread the yarn into the processing units at the beginning of the process. For example, FR 2 695 631 A1 discloses a texturing machine, wherein the yarn is guided by a threading device between a heater and a takeup device. To this end, the threading device includes a plurality of guide tubes, which connect to injectors and guide the yarn pneumatically from the outlet of the heater to the takeup device.

However, the texturing machine as disclosed in FR 2 695 631 A1 has the disadvantage that an operator must transfer the advancing yarn from a manually guided suction gun to a suction inlet of a guide tube. In this connection, it is necessary to position the yarn very accurately on the one hand and to cut it at the same time. Missed attempts in the yarn transfer from the suction gun to the guide tube are therefore unavoidable.

It is therefore an object of the invention to further develop a texturing machine of the initially described type such that before the start of the process an operator is able to transfer the yarn in a very safe and simple manner to a threading device for advancing the yarn pneumatically.

SUMMARY OF THE INVENTION

In accordance with the invention, the above and other objects and advantages are achieved by the provision of a texturing machine which includes in the region of the suction inlet of a guide tube a cutting device, which cuts the yarn while it is being threaded into the suction inlet. The special advantage of the invention thus lies in the fact that the operator needs to position only the yarn for enabling a transfer to the threading device. The combination between the cutting device and the suction inlet of the guide tube accomplishes that both the catching of the yarn and the cutting thereof occur automatically, after a manually guided suction gun reaches the threading position.

For cutting the yarn, the cutting device may comprise movable or stationary cutting means. Preferably, a stationary cutting blade is used.

A particularly advantageous further development of the invention distinguishes itself in that a positioning of the manually guided suction gun is no longer necessary. To transfer the yarn into the suction inlet, the cutting blade of the cutting device is associated with a movable yarn guide. Both the yarn guide and the cutting blade cooperate to thread the yarn into the suction inlet. In this instance, the threading position is assumed by the yarn guide, which thus ensures that the yarn is both cut and taken into the suction inlet.

In this connection, it would be possible to form the yarn guide at a free end of an elongate wire strap, so that by pivoting the wire strap the yarn guide reaches the threading position in the range of suction of the suction inlet and cutting device.

With the use of a heater with a closed heating channel, it is possible to expand the threading device advantageously by associating the guide tube with the heater, so that the yarn inlet end of the heater forms the suction inlet for threading the yarn, thereby ensuring simultaneously that the yarn is threaded into the heating channel of the heater.

Since in the production of the crimped yarn, every contact of the yarn for its guidance causes tensions and an engagement of the yarn, an advantageous further development of the invention provides that the suction inlet of the guide tube or suction inlet of the heater are in alignment with the path of the yarn leaving an upstream feed system. This permits inserting the yarn into the suction inlet directly from the feed system without a further guidance and deflection of the yarn.

In a particularly preferred further development of the invention, the feed system is formed by a godet unit, which is looped by the yarn several times, and arranged on a pivotal support that mounts at the same time the yarn guide for threading the yarn. With that, it is possible to thread on the one hand the yarn into the feed system in a simple manner, and to transfer it on the other hand simultaneously to the threading device or suction inlet of the guide tube by pivoting the support.

To realize as much as possible a compact construction of the texturing machine, an advantageous further development provides to arrange the guide tube or the heater on the underside of a frame section. This frame section is formed by a processing module mounting at least one portion of the processing units, and by a takeup module mounting the takeup device. The suction inlet of the guide tube could be arranged in the region of the processing module. The yarn would then pneumatically advance through the guide tube to the adjacent takeup module.

To guide the yarn as far as the takeup device, at least one second guide tube may be provided with a second injector, the second guide tube being positioned downstream of the first guide tube and immediately upstream of the takeup device.

The takeup device preferably includes a suction device, which has an intake opening facing a blow outlet of the second guide tube, preferably in one plane. This permits guiding the yarn automatically into the takeup device. Once the yarn is held in the suction device, for example, a yarn guide could engage the yarn and start a catching or a winding procedure.

An advantageous further development is suitable for transferring the yarn in the region of a feed system from a first guide tube to a second guide tube in a highly reliable manner. In this development, the blow outlet of the first guide tube and the suction inlet of the second guide tube face each other in one plane upstream or downstream of a feed system.

Once the yarn is transferred, it would be possible to realize an automatic threading of the yarn in the feed system, for example, by a threading device.

The method of the present invention is characterized in that it is possible to feed the yarn to a guide tube with a threading device, independently of an operator, in a very safe and reproducible manner.

BRIEF DESCRIPTION OF THE DRAWINGS

In the following, the invention is described in greater detail with reference to several embodiments of the texturing machine according to the invention and to the attached drawings, in which.

DETAILED DESCRIPTION OF THE PREFERRED EMBODIMENTS

Figure 1:
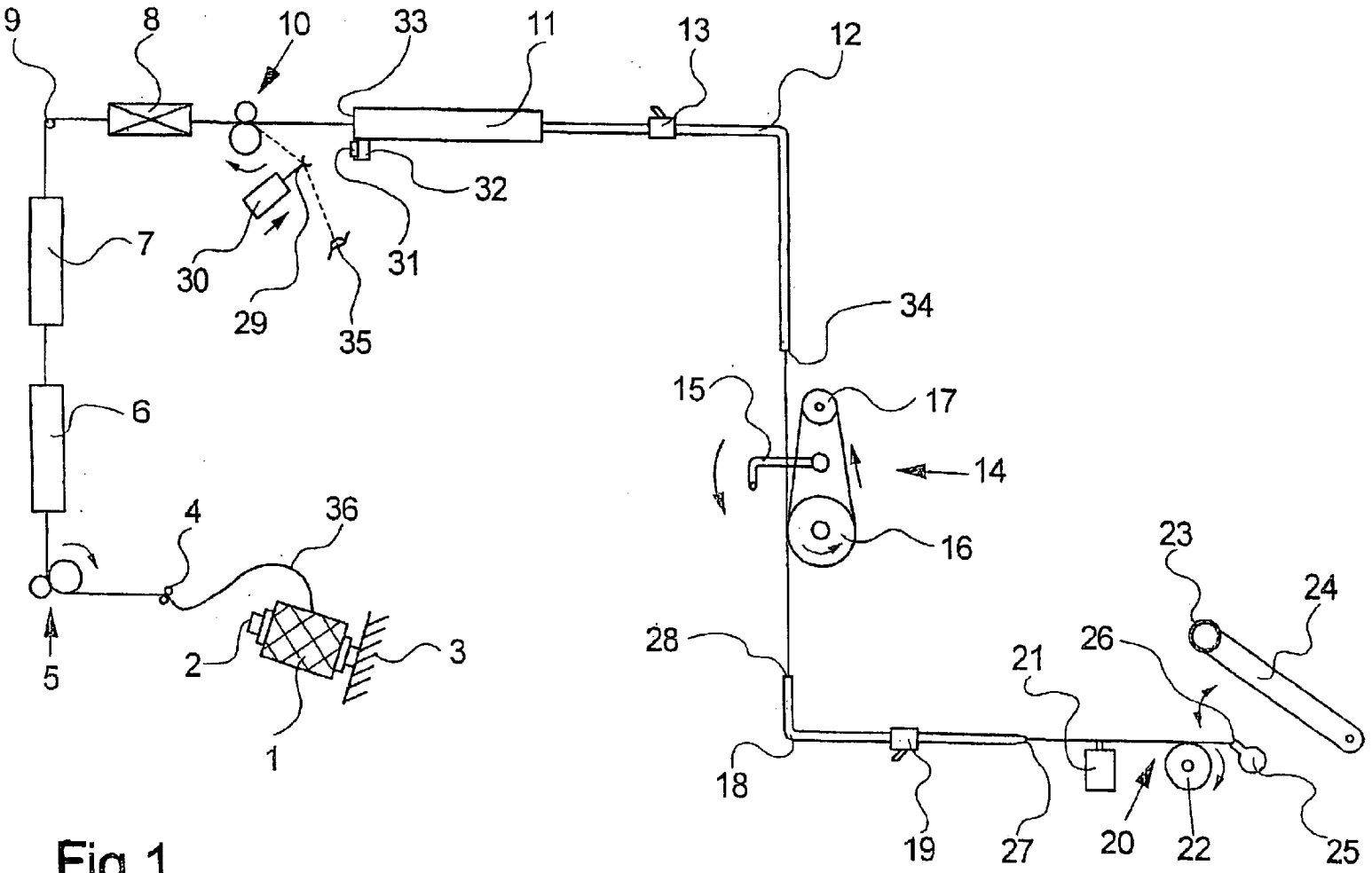
FIG. 1 is a schematic view of a first embodiment of the texturing machine according to the invention.

FIG. 1 schematically illustrates a processing station of a yarn texturing machine according to the invention. The texturing machine comprises a plurality of side by side processing stations, in each of which a yarn is textured and wound. Each of the processing stations is thus identically constructed, so that in the following the individual processing units are described with reference to the path of the yarn in one processing station.

In a creel 3, a mandrel 2 mounts a feed yarn package 1. The feed yarn package 1 holds a flat thermoplastic yarn 36. From the feed yarn package 1, the yarn 36 is withdrawn overhead by a first feed system 5. To this end, a yarn guide 4 is arranged downstream of feed yarn package 1. From the feed system 5, the yarn 36 enters a texturing zone. The texturing zone is formed by a texturing unit 8, a heating device 6, and a cooling device 7. In the present embodiment, the texturing unit 8 is realized as a false twist unit, so that the false twist produced in the yarn 36 is set within heater 6 and cooling device 7. A deflection roll 9 precedes the texturing unit 8.

A second feed system 10 withdraws the yarn 36 from the texturing zone, and advances it into an aftertreatment zone. In the aftertreatment zone, a second heater 11 is provided, which is followed by a third feed system 14. The feed system 14 is realized as a godet unit comprising a godet 16 and a guide roll 17.

The feed systems 5 and 10 are constructed, for example, as so-called nip-type feed systems, in which the yarn advances between a driven feed roll and a pressure roll lying against the circumference of the feed roll.

The feed system 14 is followed by a takeup device 20. The takeup device 20 comprises a pivotally supported package holder 24, the free end of which mounts a tube 23. For winding a package, the tube 23 lies against the circumference of a drive roll 22, which is driven by a drive at a substantially constant circumferential speed. Upstream of the contact point of yarn 36 on a package is a yarn traversing device 21, which reciprocates the yarn within the package width. Such yarn traversing devices can comprise a traversing yarn guide, which is driven by a cross-spiraled roll, or a traversing yarn guide, which is driven by a belt drive.

To be able to thread the yarn 36 in a processing station at the start of a process, the texturing machine comprises a threading device for pneumatically advancing the yarn 36. This threading device is essentially formed by guide tubes 12 and 18. To this end, the guide tube 12 with an injector 13 connects to the outlet of the second heater 11, thereby forming at the inlet end of heater 11 a suction inlet 33, through which an air stream is taken in upon activation of injector 13. The suction inlet 33 in the inlet region of heater 11 is associated with a cutting device consisting of a cutting blade 31 and a holder 32. The cutting blade 31 is attached to holder 32. Upstream of the suction inlet 33 and cutting blade 31 is a yarn guide 29, which connects to an actuator 30. The actuator 30 is used to move yarn guide 29 in the direction of suction inlet 33.

The guide tube 12 connected to heater 11 comprises at its opposite end a blow outlet 34. The blow outlet 34 terminates at an inlet end of feed system 14. Opposite thereto, at the outlet end of feed system 14, a suction inlet 28 of second guide tube 18 is arranged. In this arrangement, the blow outlet 34 of the first guide tube 12 and the suction inlet 28 of the second guide tube 18 face each other in one plane. The guide tube 18 connects to an injector 19, which generates in guide tube 18 an air stream that is directed in the direction of the advancing yarn. The guide tube 18 ends directly upstream of takeup device 20. The blow outlet 27 at the end of guide tube 18 faces, in one plane, an intake opening 26 of a suction device 25. The suction device 25 is associated with the takeup device 20 for receiving and removing the yarn 36 during package doffs.

FIG. 1 shows the processing station of the illustrated embodiment of the texturing machine directly before the start of the process. In this instance, the advancing yarn 36 has already passed through the processing units 5, 6, 7, 8, 10, 11, and 14 which are successively arranged in its path. Within the takeup device 20, the suction device 25 takes in the yarn 36 and removes it to a waste container.

For threading the yarn 36, same is first manually guided by means of a suction gun 35. Once the yarn 36 is threaded in processing units 5, 6, 7, 8, and 10, it is inserted by means of suction gun 35 into a guide groove of yarn guide 29 (shown in phantom lines). This concludes the threading procedure by an operator. The subsequent threading of yarn 36 as far as the takeup device 20 occurs automatically. To this end, the actuator 30 moves the yarn guide 29 in the direction of the suction inlet 33 of heater 11. In this process, the yarn 36 enters the range of suction of suction inlet 33. At the same time, the cutting blade 31 of the cutting device cuts the yarn end advancing between suction inlet 33 and the held suction gun 35. The yarn 36 now advances in guide tube 12 to blow outlet 34. The yarn 36 that is ejected from guide tube 12, is taken in by the suction inlet 28 of the second guide tube 18. With the use of a threading device 15, it is now possible to thread the yarn 36 that already advances parallel to the feed system 14, automatically into the godet unit. The threading device 15 could comprise, for example, a pivot drive and a pivotal yarn guide, which threads the yarn into feed system 14 by looping it several times.

Once the yarn 36 is received by guide tube 18, it is ejected from the blow outlet 27 by the air current generated in guide tube 18, and received by the intake opening 26 of suction device 25. This concludes the threading procedure of yarn 36 in the processing station of the texturing machine. The process can now be started by pivoting package holder 24 and transferring the yarn to the yarn traversing device 21 or an auxiliary device.

In the arrangement shown in FIG. 1, it is also possible to associate the cutting blade 31 with the suction inlet 33 in the inlet region of heater 11 in such a manner that a transfer and cutting of the yarn is already effected by advancing the yarn 36 thereto by means of suction gun 35. In this case, the yarn guide 29 would not be needed.

Figure 2:
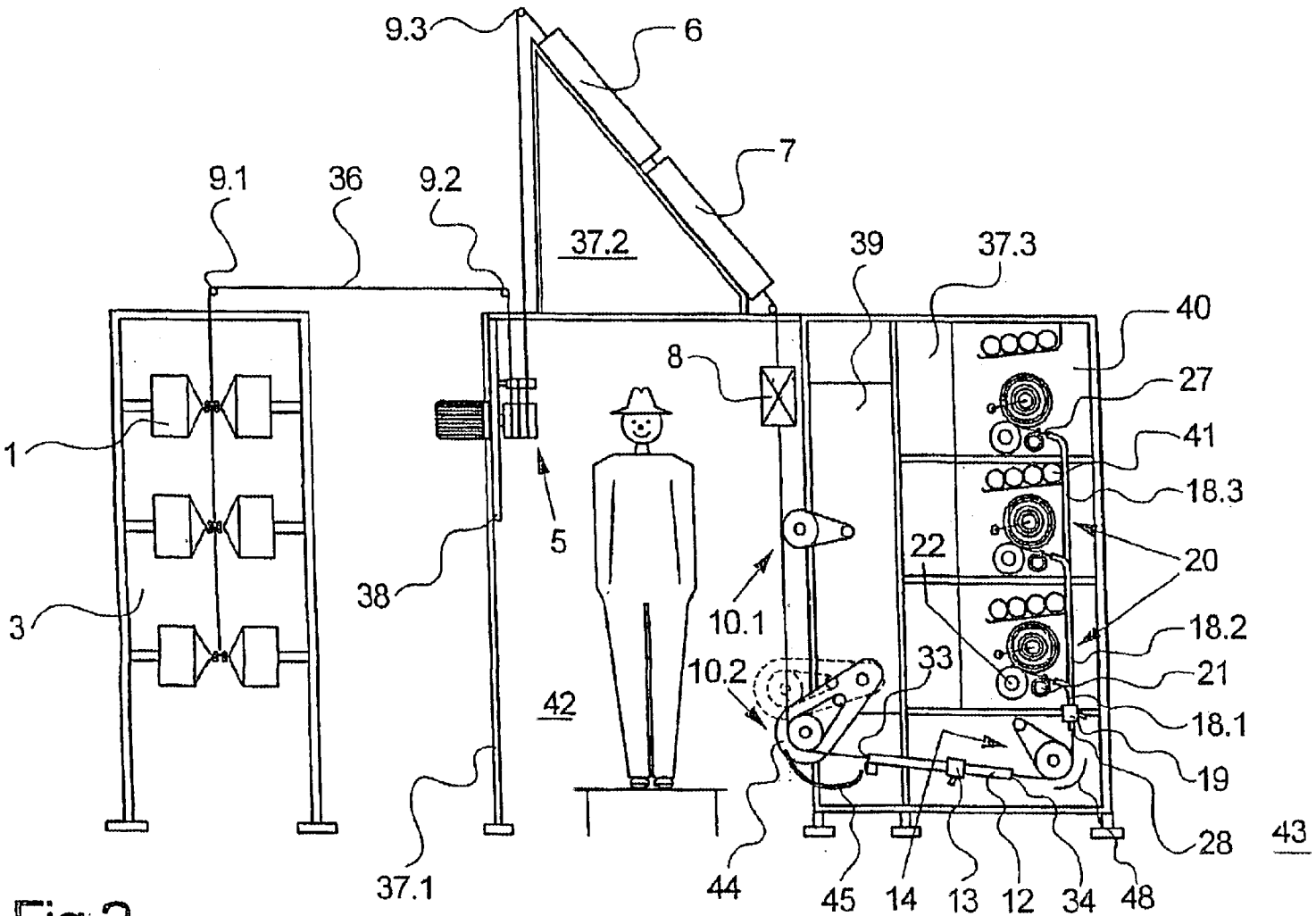
FIG. 2 is a schematic view of a further embodiment of the texturing machine according to the invention.

In the embodiment shown in FIG. 1, the frame sections, which mount the processing units, are left out for the sake of clarity. In contrast, FIG. 2 is a view of an embodiment of the texturing machine according to the invention, which shows the machine frame for accommodating the processing units. The embodiment of the texturing machine of FIG. 2 comprises a feed module 38, a processing module 39, and a takeup module 40, which are arranged in a machine frame with frame sections 37.1, 37.2, 37.3. The feed module 38 is supported by frame section 37.1, and the takeup module 40 by frame section 37.3. The frame sections 37.1 and 37.3 are interconnected by frame section 37.2, which is arranged above feed module 38 and processing module 39. Between the processing module 39 and feed module 38, a servicing aisle 42 is formed below frame section 37.2.

In the frame section 37.2, the processing module 39 is arranged on the side facing servicing aisle 42 and the takeup module 40 on the opposite side thereof. A doffing aisle 43 is provided along the takeup module 40.

In its longitudinal direction (the drawing plane of FIG. 2 corresponds to the transverse plane), the texturing machine comprises a plurality of processing stations, one for each yarn. The takeup devices 20 occupy a width of three processing stations. For this reason, three takeup devices 20 overlie one another in a column in the takeup module 40.

The processing units arranged in the machine frame 37, are basically identical with the foregoing embodiment, so that in the following only their essential differences are described. The first feed system 5 on feed module 38 is associated with a creel 3, which accommodates three feed yarn packages 1, one above the other. The creel 3 also holds a reserve yarn package in facing relationship with each feed yarn package 1. In the direction of the advancing yarn, downstream of the first feed system 5, a heater 6 and a cooling device 7 extend, which are successively arranged in one plane and supported by frame section 37.2 above the servicing aisle 42. In this arrangement, the yarn advances between creel 3, feed system 5, and heater 6 over a plurality of deflection rolls 9.1, 9.2, and 9.3.

The processing module 39 mounts, one below the other in the direction of the advancing yarn, a texturing unit 8, as well as two successive feed systems 10.1 and 10.2.

On the underside of frame section 37.3, the third feed system 14 on takeup module 40 is arranged in facing relationship with feed system 10.2. From the third feed system 14, the yarn advances to the takeup device 20, which is arranged on the takeup module 40. In comparison with the above-described embodiment, the takeup device 20 includes a tube magazine 41 and auxiliary devices not shown, so as to be able to perform an automatic package doff.

For threading the yarn, the frame section 37.3 mounts a threading device, which is formed by guide tubes 12 and 18 and their associated injectors 13 and 19.

Figure 3:
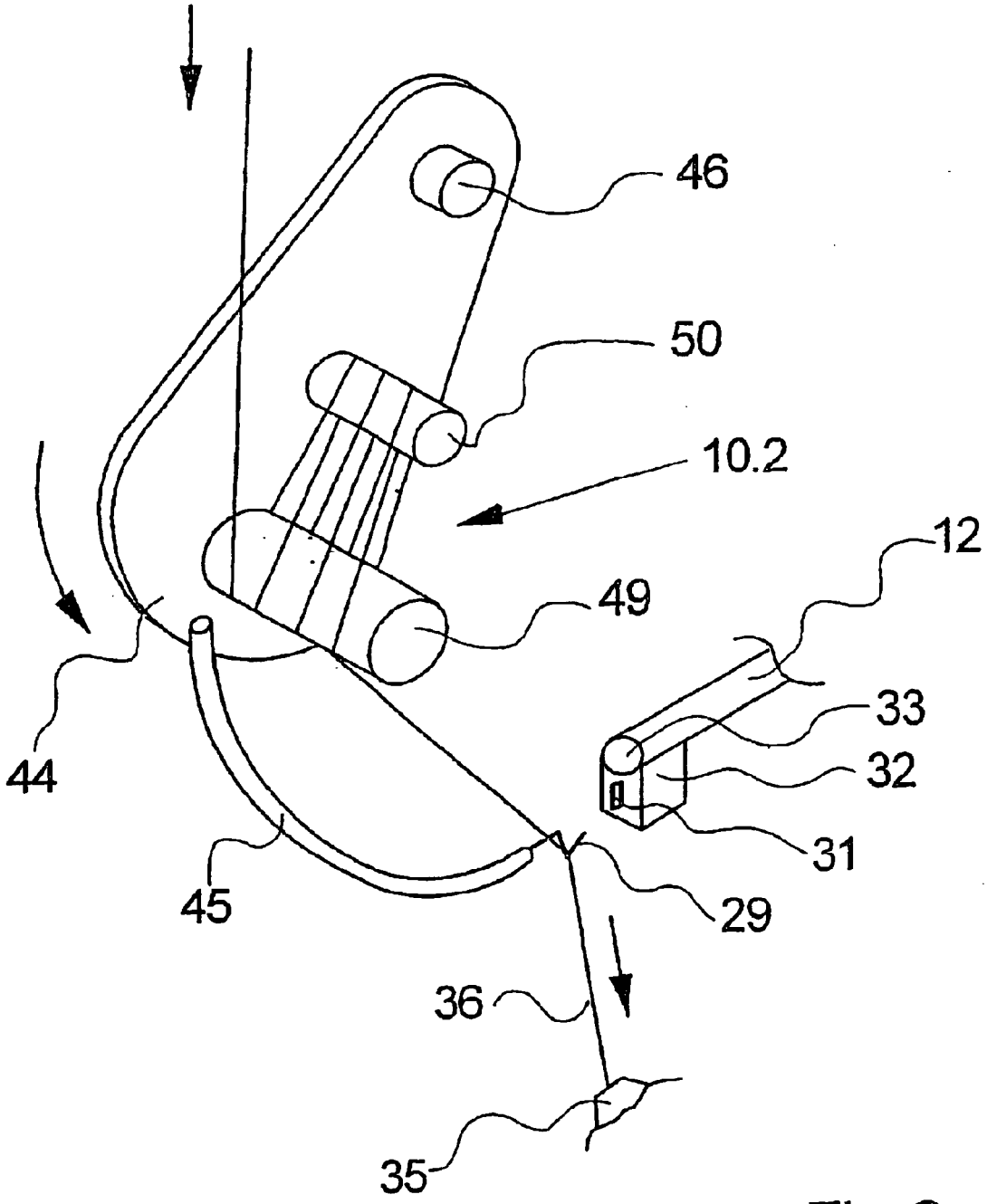
FIG. 3 is a schematic partial view of the embodiment of FIG. 2.

The suction end of guide tube 12 as well as the feed system 10.2 upstream thereof are schematically illustrated in FIG. 3 which is a partial view of FIG. 2. The feed system 10.2 comprises a driven godet 49 and a guide roll 50, which are arranged on a support 44. At its one end, the support 44 is held on a pivot axle 46 and can be pivoted between a contacting position and a threading position. FIG. 2 illustrates the support 44 in the threading position, and FIG. 3 shows it shortly before reaching the threading position. The free end of support 44 mounts the yarn guide 29. In the threading position, the support 44 moves the yarn 29 directly in front of the suction inlet 33 of guide tube 12. Associated with the suction inlet 33 of guide tube 12 is cutting blade 31, which is attached to holder 32.

For threading the yarn on feed system 10.2, the support 44 is pivoted to a threading position that extends into servicing aisle 42, as is shown in phantom lines in FIG. 2. By means of suction gun 35, the operator loops the yarn several times about feed system 10.2, and inserts it from its takeoff point on feed system 10.2 into the yarn guide 29 at the end of wire strap 45. Subsequently, the support 44 is pivoted to the threading position, which represents at the same time the operating position of feed system 10.2. In this process, the yarn guide 29 moves the yarn 36 in front of suction inlet 33. The yarn 36 is then cut by cutting blade 31 in its length that advances toward a suction gun, and pneumatically advanced through guide tube 12.

As shown in FIG. 2, the blow outlet 34 at the end of guide tube 12 faces a deflection plate 48. Arranged at an angle of about 90° therewith is the suction inlet 28 of the second guide tube 18.1, 18.2, or 18.3. In the intersections with the blow direction of the first guide tube 12 and with the suction direction in the second guide tube, the deflection plate 48 extends preferably with a deflection curvature corresponding to the direction. This accomplishes that the loose yarn, which is ejected from the blow outlet 34 of guide tube 12, can be directly taken in by the activated suction inlet 28 of second guide tube 18.1, 18.2, or 18.3.

At its opposite end, the guide tube 18 comprises a blow outlet 27 in facing relationship with a suction system of takeup device 20, which is not shown.

In the texturing machine shown in FIG. 2, the yarn is guided in each processing station through the successively arranged guide tubes 12 and 18.1, 18.2, and 18.3. In the region of takeup module 40, successive guide tubes 18.1, 18.2, and 18.3 are shown, which guide a yarn to respective ones of the takeup devices 20.

The embodiments shown in FIGS. 1 and 2 of the texturing machine are exemplary in the arrangement and configuration of the processing units. Basically, it is possible to drive, for example, adjacent feed systems jointly or each by an individual drive. Important is that the arrangement of the processing units in the texturing machine is such that it permits a simple and reproducible threading of the yarn by means of a threading device for advancing the yarn pneumatically. For example, the embodiment of FIG. 2 could be supplemented with a second heater, which would be arranged between the feed systems 10.2 and 14. Likewise possible are additional processing units, such as an entanglement device, which could be arranged between the feed systems 10.1 and 10.2, or yarn lubrication devices upstream of the takeup devices 20.

The cutting device shown in the embodiments and consisting of a stationary cutting blade and a holder, is likewise exemplary. The cutting device could also comprise a movable cutting blade, which cooperates, for example, with a stationary yarn guide. It is also possible that the cutting device includes a plurality of cutting blades for cutting the yarn by the operating principle of scissors.

What is claimed is:

1. A yarn texturing machine comprising a plurality of yarn processing units which are serially arranged along a yarn path of travel leading to a takeup device, a threading device for initially threading a yarn along at least a portion of the path of travel, said threading device comprising a guide tube and an air injector connected to the guide tube, with the guide tube including a suction inlet for taking in the yarn and a blow outlet for ejecting the yarn, and a cutting device positioned adjacent the suction inlet for cutting the yarn while it is being initially threaded into the suction inlet.

2. The yarn texturing machine of claim 1 wherein the cutting device comprises a cutting blade and a movable yarn guide positioned to move the yarn into engagement with the cutting blade to cut the yarn and so that the cut end of the yarn is drawn into the suction inlet.

3. The yarn texturing machine of claim 2 wherein the yarn guide is mounted at the free end of a pivotally mounted elongate strap, and wherein the yarn may be pivoted to a threading position where the retained yarn engages the cutting blade and is within a range of suction of the suction inlet.

4. The yarn texturing machine of claim 1 wherein the guide tube includes a heater having a closed heating channel and an inlet end, and such that the inlet end of the heater forms the suction inlet.

5. The yarn texturing machine of claim 1 wherein the plurality of yarn processing units include a feed system positioned upstream of the guide tube and so that the yarn leaving the feed system is aligned with the suction inlet.

6. The yarn texturing machine of claim 5 wherein said feed system comprises a godet unit which is mounted on a pivotal support, and wherein the cutting device comprises a cutting blade and a yarn guide, with one of said cutting blade and yarn guide being mounted to the pivotal support and the other of the cutting blade and yarn guide being fixedly mounted adjacent said suction inlet.

7. The yarn texturing machine of claim 6 wherein the godet unit comprises a driven godet and an associated guide roll which are looped by the yarn.

8. The yarn texturing machine of claim 1 further comprising a processing module which mounts at least a portion of the yarn processing units, and a takeup module which mounts the takeup device, with said processing module and said takeup module being joined to form a frame section which is arranged between a doffing aisle which is adjacent the takeup module and a servicing aisle which is adjacent the processing module.

9. The yarn texturing machine of claim 8 wherein the guide tube is arranged on the underside of the frame section and forms at least a portion of a yarn path between the processing module and the takeup module.

10. The yarn texturing machine of claim 1 further comprising a second threading device for initially threading the yarn along a portion of the yarn path of travel downstream of said first mentioned threading device, said second threading device comprising a second guide tube and an air injector connected to the second guide tube, and with the second guide tube positioned for advancing the yarn to the takeup device.

11. The yarn texturing machine of claim 10 wherein the second guide tube includes a blow outlet, and wherein the takeup device includes a suction device which has an opening which is aligned with the blow outlet of the second guide tube.

12. The yarn texturing machine of claim 10 wherein the second guide tube includes a suction inlet and a blow outlet, and wherein said plurality of yarn processing units includes a feed system positioned between the blow outlet of the first mentioned guide tube and the suction inlet of the second guide tube.

13. The yarn texturing machine of claim 12 wherein the blow outlet of the first mentioned guide tube and the suction inlet of the second guide tube are aligned with each other.

14. The yarn texturing machine of claim 12 wherein said feed system includes a driven feed godet and a guide roll, and a threading device for looping the yarn around the godet and guide roll.

15. A method of threading an advancing yarn onto a texturing apparatus which comprises a plurality of yarn processing units which are serially arranged along a yarn path of travel leading to a takeup device, comprising the steps of positioning a guide tube along a portion of the yarn path of travel and generating an air flow within the tube so that the tube defines a suction inlet and a blow outlet, engaging the advancing yarn with a yarn guide and moving the yarn guide and the engaged yarn to a threading position immediately upstream of the suction inlet of the guide tube and so that the yarn is cut by a cutting blade with the cut end being engaged by the suction effect at the suction inlet of the guide tube.

16. The method of claim 15 wherein the plurality of processing units comprise a yarn heater positioned to form at least an upstream end portion of the guide tube.

* * * * *